US008544388B2

(12) United States Patent
Reunamäki et al.

(10) Patent No.: US 8,544,388 B2
(45) Date of Patent: Oct. 1, 2013

(54) ARRANGEMENT FOR SUPPORTING SHELL INTO BREECH-LOADING WEAPON BARREL

(75) Inventors: Kari Reunamäki, Tampere (FI); Pekka Niemi, Jämijärvi (FI)

(73) Assignee: Patria Land Systems Oy, Helsinki (FI)

( * ) Notice: Subject to any disclaimer, the term of this patent is extended or adjusted under 35 U.S.C. 154(b) by 239 days.

(21) Appl. No.: 12/810,188

(22) PCT Filed: Jan. 30, 2009

(86) PCT No.: PCT/FI2009/050081

§ 371 (c)(1),
(2), (4) Date: Jul. 21, 2010

(87) PCT Pub. No.: WO2009/095543

PCT Pub. Date: Aug. 6, 2009

(65) Prior Publication Data

US 2010/0288153 A1 Nov. 18, 2010

(30) Foreign Application Priority Data

Jan. 31, 2008 (FI) ..... 20085075

(51) Int. Cl.
*F42B 10/00* (2006.01)

(52) U.S. Cl.
USPC ..... 102/473; 102/501

(58) Field of Classification Search
USPC ..... 102/439, 293, 469, 483, 372–374, 102/376, 380, 430, 445, 470
See application file for complete search history.

(56) References Cited

U.S. PATENT DOCUMENTS

| | | | | | |
|---|---|---|---|---|---|
| 3,038,382 | A * | 6/1962 | Noyes et al. | 89/1.816 |
| 4,444,115 | A * | 4/1984 | Romer et al. | 102/431 |
| 4,763,577 | A | 8/1988 | Romer et al. | |
| 4,864,698 | A * | 9/1989 | Brame | 24/442 |
| 5,160,804 | A * | 11/1992 | Wahner et al. | 102/443 |
| 5,179,250 | A | 1/1993 | Campoli | |
| 5,503,080 | A * | 4/1996 | Goward et al. | 102/293 |
| 5,860,779 | A * | 1/1999 | Toosky et al. | 411/432 |
| 6,257,148 | B1 * | 7/2001 | Toivonen et al. | 102/439 |
| 6,772,693 | B2 * | 8/2004 | Kuru et al. | 102/293 |
| 2004/0107857 | A1 | 6/2004 | Kuru et al. | |
| 2004/0265090 | A1 * | 12/2004 | Stone | 411/338 |

FOREIGN PATENT DOCUMENTS

| | | |
|---|---|---|
| GB | 2 105 813 A | 3/1983 |
| WO | 98/00064 A2 | 1/1998 |

* cited by examiner

*Primary Examiner* — Samir Abdosh
(74) *Attorney, Agent, or Firm* — Birch, Stewart, Kolasch & Birch, LLP

(57) ABSTRACT

An arrangement for supporting a shell (1) into the barrel of a breech-loading weapon, the arrangement comprising a support piece (4) provided with a rim flange (15) and to be fastened to the tail of the shell (1), the support piece being fastened in connection with the tail of the shell (1) with one or more adhesive materials. In addition, a method of fastening a support piece (4) to a shell (1).

7 Claims, 2 Drawing Sheets

ARRANGEMENT FOR SUPPORTING SHELL INTO BREECH-LOADING WEAPON BARREL

BACKGROUND OF THE INVENTION

The invention relates to an arrangement for supporting a shell into the barrel of a breech-loading weapon, the arrangement comprising a support piece provided with a rim flange and to be fastened in connection with the tail of the shell.

The invention further relates to a method of fastening a support piece to a shell, the method comprising fastening the support piece provided with a rim flange in connection with the tail of the shell.

Mortars are nowadays mounted on movable bases, allowing them to be moved from one place to another and, correspondingly, allowing them to be rapidly moved from the emplacement. A problem in such solutions is the ability of said base, i.e. vehicle, to defend itself against possible attacks, and the use of the vehicle for destroying close-range targets on the ground. A moving base provided with a heavy mortar is normally unable to carry heavy defensive facilities in addition to the mortar, instead, it is at most provided with a heavy machine gun or corresponding lighter armature. In such a situation, it is necessary to be able to use the mortar also for firing in the horizontal plane or below it, for which normal mortar shells and mortars are not suited. In the case of a normal mortar having a smooth barrel, when the barrel of the mortar is oriented in the horizontal direction or below it, the shell inside the barrel is able to move in the barrel in such a manner that it either falls from the barrel or moves forward to such an extent that the firing pin of the mortar no longer hits the shell, and the shell does not go off. A solution to this problem is described in US publication 5 503 080, disclosing a control and fastening piece to be fastened to the tail of a conventional shell by means of a friction-based clip bond. However, such a friction-based bond is not as such very dependable and, in addition, the tolerances of both the manufacture of the shell and the manufacture of the control and fastening pieces cause variations in the fastening force and the stability.

WO application Fl 98/00064 presents a solution, wherein a support piece provided with a rim flange is fastened to the tail of a conventional shell by means of a mechanical locking.

BRIEF DESCRIPTION OF THE INVENTION

An object of the present invention is to provide a new type of arrangement for supporting a shell into the barrel of a breech-loading weapon.

The arrangement of the invention is characterized in that the support piece is arranged in connection with the tail of the shell with one or more adhesive materials.

The method of the invention is characterized by fastening the support piece in connection with the tail of the shell with one or more adhesive materials.

The arrangement for supporting a shell into the barrel of a breech-loading weapon comprises a support piece provided with a rim flange to be fastened in connection with the tail of the shell and fastened in connection with the tail of the shell with one or more adhesive materials.

By using one or more different adhesive materials, such as glue, tape or sticker tape, for example, for fastening the support piece to the shell, the support piece can be fastened to the shell easily and in a manner implementable inexpensively.

According to an embodiment, the support piece has a control rim comprising a first surface to be oriented towards a side edge of a fin of the shell, and a second surface to be oriented towards an end edge of a fin of the shell, and that the support piece is fastened in connection with the tail of the shell by means of an adhesive material arranged between the side edge of at least one fin of the shell and the first surface of the control rim of the support piece and/or by means of an adhesive material arranged between the end edge of at least one fin of the shell and the second surface of the control rim of the support piece.

According to another embodiment, the support piece is provided with a central sleeve part having an end surface oriented in the direction of the fastening element of the primer of the basic charge of the shell, and that the support piece is fastened in connection with the tail of the shell by means of an adhesive material arranged between the end surface of the sleeve part of the support piece and the fastening element of the primer of the basic charge of the shell.

According to a third embodiment, the sleeve part of the support piece is provided with a thread in connection with which a fastening piece provided with a thread corresponding to the thread in the sleeve part of the support piece is arranged, and that said fastening piece is fastened in connection with the fastening element of the primer of the basic charge of the shell by means of an adhesive material arranged between said fastening piece and the fastening element.

BRIEF DESCRIPTION OF THE FIGURES

In the following, some embodiments of the invention will be described in more detail in the accompanying drawings, in which FIG. 1 schematically shows a side view of a shell and a support piece arranged in connection with the tail thereof, FIG. 2 schematically shows a side view in partial cross-section of an arrangement for supporting a shell, FIG. 3 schematically shows a side view in partial cross-section of another arrangement for supporting a shell, and FIG. 4 schematically shows a side view in partial section of a third arrangement for supporting a shell.

In the figures, some embodiments of the invention are shown in a simplified manner for the sake of clarity. In the figures, like parts are denoted with like reference numerals.

DETAILED DESCRIPTION OF THE INVENTION

Figure 1:
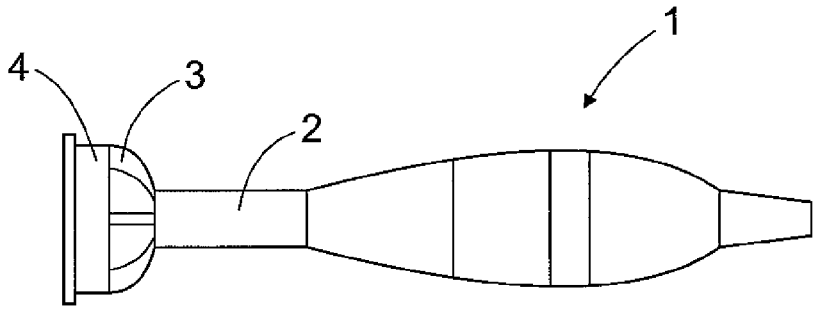

FIG. 1 schematically shows a side view of a shell 1 of a mortar, known per se, having a tail tube 2. The end of the tail tube 2 is provided with fins 3 for controlling the flight of the shell. In connection with the tail tube 2, a support piece 4, shown in more detail in FIG. 2, for example, is arranged, via which the shell can be supported into the barrel of the mortar in such a manner that the shell cannot move in the mortar barrel, even if the barrel were directed horizontally or even obliquely downwards below the horizontal plane. The general structure and operational principle of shell mortars and shells are known per se to a person skilled in the art, and they do not therefore have to be dealt with in any more detail in this context.

Figure 2:
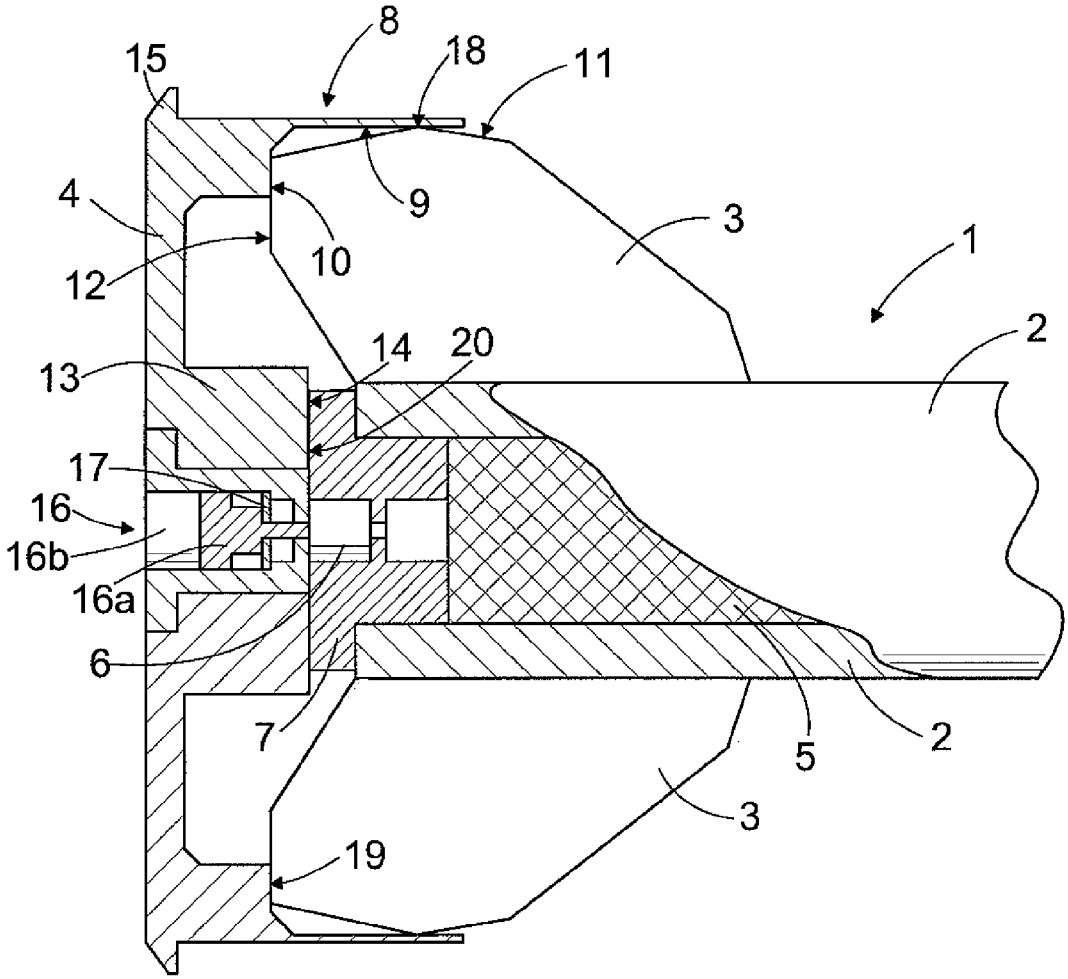

FIG. 2 schematically shows a side view in partial cross-section of an arrangement for supporting a shell into the barrel of a breech-loading weapon. For the sake of clarity, FIG. 2 does not show said weapon or the barrel thereof. Inside the tail tube 2 of the shell 1 is a basic charge 5, by means of which the shell 1 is fired out of the barrel of the weapon, i.e. the shell mortar. For firing the basic charge 5, inside the tail tube 2 is a primer 6 mounted fixed to the tail tube 2 by means of a separate fastening element 7. The fastening element 7 usually comprises threads, not shown per se in the figure, by means of which the fastening element 7 of the primer 6 is fastened to the tail tube 2. Normally, when shells are fired with a shell mortar, the firing pin of the shell mortar hits the primer 6, which makes the basic charge 5 fire, throwing the shell out of the barrel of the mortar.

FIG. 2 further shows a support piece 4 to be fastened in connection with the tail 2 of the shell 1, the support piece 4 supporting the shell 1 into the barrel of the shell mortar such that the shell 1 cannot move in the barrel of the mortar, even if the barrel were directed horizontally or even obliquely downwards below the horizontal plane. The support piece 4 resembles a short case base and has a cylindrical control rim 8 having a first surface 9 oriented in parallel with the longitudinal direction of the shell 1 when the support piece 4 is being arranged in connection with the shell 1, and a second surface 10 perpendicular relative to the first surface 9. The cylindrical control rim 8 of the support piece 4 extends around the fins 3 of the shell 1 such that at least part of a side edge 11 of the fin 3 of the shell 1 rests against the first surface 9 of the control rim 8 of the support piece 4, and at least part of a rear edge 12 of the fin 3 of the shell 1 rests against the second surface 10 of the control rim 8 of the support piece 4, whereby the shell 1, when in the barrel of the weapon, settles substantially straight and centrally in the barrel of the weapon.

The support piece 4 further comprises a sleeve part 13 arranged substantially centrally relative to the support piece 4 and comprising an end surface 14 oriented in the direction of the fastening element 7 of the primer 6. The sleeve part 13 is dimensioned in the longitudinal direction of the shell in such a manner that when the support piece 4 is fastened to the tail of the shell, the end surface 14 of the sleeve part 13 extends up to the fastening element 7 of the primer 6.

The support piece 4 further comprises a rim flange 15 that settles in a groove at the rear part of the barrel of the weapon, keeping the shell 1 in the right position in the barrel irrespective of the position of the barrel, while the control rim 8 of the support 4 seals the barrel of the weapon. The support piece 4 further comprises a firing member 16, which in the embodiment shown in the figure comprises an intermediate firing pin 16*a* and an electric primer 16*b*. The intermediate firing pin 16*a* is normally kept in position by a separate closing plate or a corresponding locking member 17 preventing the intermediate firing pin 16*a* from moving, but after the electric primer 16*b* goes off, yields to an extent letting the intermediate firing pin 16*a* hit the primer 6 of the shell 1 and thus fire the basic charge 5 of the shell 1. Instead of an electric primer, a conventional primer may naturally be used, which the firing pin of the weapon hits upon firing, thus firing the primer of the basic charge of the shell via the intermediate firing pin.

The support piece 4 may be fastened in connection with the tail of the shell 1 by means of one or more different adhesive materials. This may be carried out for instance by arranging suitable adhesive material between the first surface 9 of the control rim 8 of the support piece 4 and the side edge 11 of the fin 3 of the shell 1 in a manner making the support piece 4 fasten to the shell 1 by means of a fastening generated between the first surface 9 of the control rim 8 of the support piece 4 and the side edge 11 of the fin 3 of the shell 1. Thus, a fastening point denoted with reference numeral 18 in FIG. 2 is generated between the support piece 4 and the fin 3 of the shell 1. Preferably, adhesive material is arranged between the first surface 9 of the control rim 8 of the support piece 4 and the side edge 11 of each fin 3 of the shell 1.

As adhesive material, glue, tape, double sided tape or sticker tape, for example, may be used. Glues and tapes create a fastening based on a chemical bond, whereas sticker tape may create either a fastening based on a chemical bond or a fastening based on a mechanical bond. The sticker tape may be for instance a sticker tape whose first side or portion comprises hooks and the other side or portion loops, whereby the first side or portion of the sticker tape comprising hooks is fastened for instance to the first surface 9 of the control rim 8 of the support piece 4, and the second side or portion of the sticker tape comprising loops is fastened to the side edge 11 of the fin 3 of the shell 1, whereby said hooks of the sticker tape are fastened to said loops of the sticker tape when the support piece 4 is being fastened to the shell 1, thus fastening the support piece 4 to the shell 1. As regards the fastening force, the properties of the adhesive material are selected in such a manner that with the support piece 4 fastened to the shell 1, the shell cannot be detached from the support piece 4 during its normal handling, storage, transfer, transport or loading into a weapon, but which fastening breaks or is detached when the basic charge 5 of the shell 1 is fired by the action of a pushing force generated by the basic charge that forces the shell 1 out of the weapon barrel. In this case, the shell 1 thus flies out of the weapon barrel and the support piece 4 remains in place within the weapon barrel.

By using one or more different adhesive materials, such as glue, tape or sticker tape, for example, for fastening the support piece 4 to the shell 1, the support piece 4 can be fastened to the shell 1 easily and in a manner implementable inexpensively.

In addition to or instead of the fastening to be generated between the first surface 9 of the control rim 8 of the support piece 4 and the side edge 11 of the fin 3 of the shell 1, the support piece 4 may also be fastened to the shell 1 by means of a fastening generated between the second surface 10 of the control rim of the support piece 4 and the rear edge 12 of the fin 3 of the shell 1. Accordingly, in this case, a suitable adhesive material is arranged between the second surface 10 of the control rim 8 of the support piece 4 and the rear edge 12 of one or more fins, preferably each fin 3 of the shell 1 in such a manner that a fastening is generated between the second surface 10 of the control rim 8 of the support piece 4 and the rear edges 12 of the fins 3 for fastening the support piece 4 to the shell 1. In FIG. 2, said fastening point is schematically shown with reference numeral 19.

In addition to or instead of the above-described fastening points, the support piece 4 may be fastened to the shell 1 also by means of a fastening generated between the end surface 14 of the sleeve part 13 of the support piece 4 and the fastening element 7 of the primer 6 of the shell 1. Accordingly, in this case, suitable adhesive material is arranged between the end surface 14 of the sleeve part 13 of the support piece 4 and the fastening element 7 of the primer 6 of the shell 1 in such a manner that a fastening is generated therebetween for fastening the support piece 4 to the shell 1. In FIG. 2, said fastening point is schematically shown with reference numeral 20.

Figure 3:
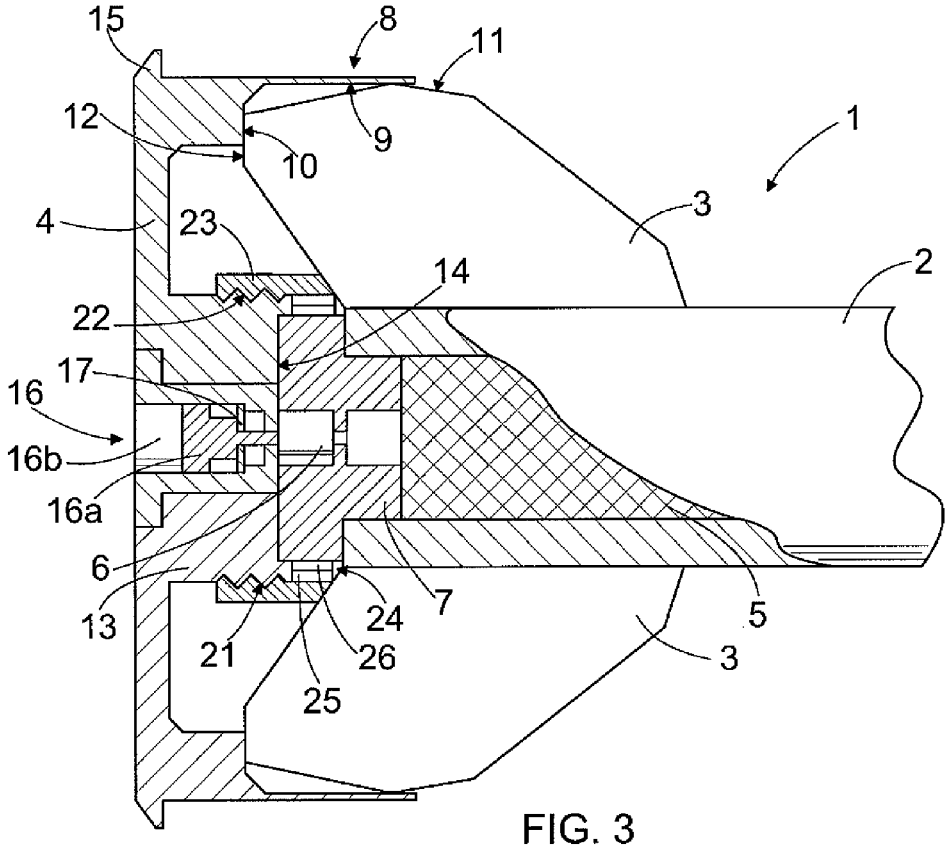

FIG. 3 schematically shows a side view in partial cross-section of another arrangement for supporting a shell into the barrel of a breech-loading weapon. For the sake of clarity, FIG. 3 does not show said weapon or the barrel thereof. The embodiment shown in FIG. 3 is mainly similar to the embodiment shown in FIG. 2, but in the embodiment of FIG. 3, the sleeve part 13 of the support piece 4 is provided with a thread 21. In connection with the support piece 4, a fastening piece 23 or a fastening sleeve 23 provided with a thread 22 corresponding to the thread 21 is arranged by rotating said support piece 4 and said fastening piece 23 relative to one another. The fastening piece 23 may be fastened to the sleeve part 13 of the support piece 4 also by other methods than a threaded bond, with glue or tape and so on, for example, or it may be fabricated as part of the support piece 4, whereby no bonds are required. Said fastening piece 23 is fastened in connection with the fastening element 7 of the primer 6 of the shell 1 by means of an adhesive material arranged between said fastening piece 23 and the fastening element 7. Said adhesive material may be for instance a tape 24 whose backing surface 25 is fastened to the fastening piece 23 and whose adhesive surface 26 adheres to the fastening element 7, thus fastening the support piece 4 to the shell 1. In FIG. 3, the backing surface 25 and the adhesive surface 26 of said tape 24 are shown substantially thicker than they actually are with respect to the structures of the support piece 4 and the shell 1 for the sake of clarity. Instead of the embodiment shown in FIG. 3, the backing surface 25 of the tape 24 may naturally be fastened to the fastening element 7 of the primer 6, whereby the adhesive surface 26 of the tape 24 adheres to the fastening piece 23.

Figure 4:
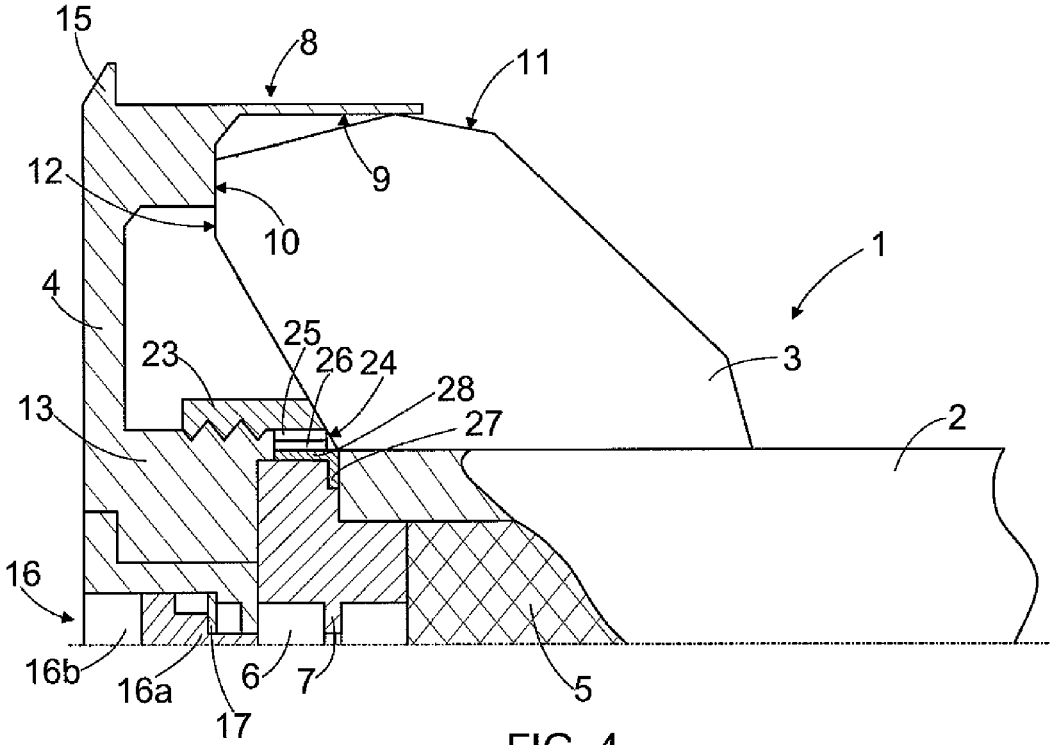

FIG. 4 schematically shows a side view in partial section of a third arrangement for supporting a shell into the barrel of a breech-loading weapon. For the sake of clarity, FIG. 4 does not show said weapon or the barrel thereof. The embodiment shown in FIG. 4 is mainly similar to the embodiment shown in FIG. 3, but in the embodiment of FIG. 4, an intermediate piece 28 provided with a shoulder 27 is arranged between the fastening piece 23 and the fastening element 7 of the primer 6 of the basic charge 5, said shoulder being located between the fastening element 7 of the primer 6 of the basic charge 5 and the tail tube 2, supporting the intermediate piece 28 to the fastening element 7 of the primer 6. To the fastening piece 23, adhesive material is fastened, such as tape 24, for example, whose backing surface 25 is fastened to the fastening piece 23 and whose adhesive surface 26 adheres to the fastening element 7, thus fastening the support piece 4 to the shell 1. In FIG. 4, the backing surface 25 and the adhesive surface 26 of said tape 24 are shown substantially thicker than they actually are with respect to the structures of the support piece 4 and the shell 1 for the sake of clarity. Instead of the embodiment shown in FIG. 4, the backing surface 25 of the tape 24 may naturally be fastened to the fastening element 7 of the primer 6 of the propelling charge 5, whereby the adhesive surface 26 of the tape 24 adheres to the support piece 23 when the support piece 4 is being fastened to the shell 1.

In the embodiments shown in FIGS. 3 and 4, other adhesive materials than tape may naturally also be used, such as glue or a sticker tape provided as a hook-loop structure.

In some cases, the features presented in the present application may be used as such, irrespective of other features. On the other hand, if need be, the features presented in the present application may be combined for generating various combinations.

The drawings and the related description are only intended to illustrate the idea of the invention. The details of the invention may vary within the scope of the claims. FIGS. 2 to 4 show a feasible structure of the support piece, but it is to be noted that the structure of the support piece may vary in a plurality of different ways in a manner allowing the support piece to be fastened in connection with the tail of a shell by means of one or more adhesive materials.

The invention claimed is:

1. An arrangement for supporting a shell in the barrel of a breech-loading weapon, the arrangement comprising a support piece provided with a rim flange and configured to be fastened to a tail of the shell with one or more adhesive materials, wherein the adhesive material is a sticker tape material comprising hooks and loops and creating a mechanical bond, wherein the support piece is provided with a control rim comprising a first surface to be oriented towards a side edge of a fin of the shell, and a second surface to be oriented towards an end edge of a fin of the shell, and wherein the sticker tape material is arranged between the side edge of at least one fin of the shell and the first surface of the control rim of the support piece or the sticker tape material is arranged between the end edge of at least one fin of the shell and the second surface of the control rim of the support piece.

2. A method of fastening a support piece to a shell, the method comprising fastening the support piece provided with a rim flange to a tail of the shell with one or more adhesive materials, wherein the adhesive material is a sticker tape material creating a mechanical bond and comprising hooks and loops, wherein the support piece is provided with a control rim comprising a first surface to be oriented towards a side edge of a fin of the shell, and a second surface to be oriented towards an end edge of a fin of the shell, and wherein at least one of sticker tape material is arranged between the side edge of at least one fin of the shell and the first surface of the control rim of the support piece and sticker tape material is arranged between the end edge of at least one fin of the shell and the second surface of the control rim of the support piece to fasten the support piece to the tail of the shell.

3. An arrangement as claimed in claim 1, wherein the adhesive material is selected such that the fastening of the support piece to the tail of the shell is broken when the basic charge of the shell is fired.

4. A method as claimed in claim 2, wherein the adhesive material is selected such that the fastening of the support piece to the tail of the shell is broken when the basic charge of the shell is fired.

5. An arrangement as claimed in claim 1, wherein the support piece is provided with a substantially central sleeve part, the sleeve part having an end surface oriented in the direction of and contacting a fastening element of a primer of a basic charge of the shell, and wherein the support piece is fastened to the tail of the shell by means of the adhesive material arranged between the end surface of the sleeve part and the fastening element of the primer of the basic charge of the shell.

6. A method as claimed in claim 2, wherein the support piece is provided with a substantially central sleeve part, the sleeve part having an end surface oriented in the direction of and contacting the fastening element of a primer of a basic charge of the shell, and wherein the adhesive material is arranged between the end surface of the sleeve part and the fastening element of the primer of the basic charge of the shell to fasten the support piece to the tail of the shell.

7. An arrangement for supporting a shell in the barrel of a breech-loading weapon, the arrangement comprising a support piece provided with a rim flange and configured to be fastened to a tail of the shell with one or more adhesive materials, wherein the adhesive material is a sticker tape material comprising hooks and loops and creating a mechanical bond, wherein the support piece is provided with a substantially central sleeve part, the sleeve part having an end surface oriented in the direction of and contacting a fastening element of a primer of a basic charge of the shell, and wherein the support piece is fastened to the tail of the shell by means of the adhesive material arranged between the end surface of the sleeve part and the fastening element of the primer of the basic charge of the shell.

* * * * *